United States Patent [19]

Correa

[11] 3,958,801

[45] May 25, 1976

[54] PROTECTIVE CUSHION FOR GYMNASTIC EQUIPMENT

[76] Inventor: Ronald J. Correa, 97 Ocean Grove Ave., Swansea, Mass. 02777

[22] Filed: Apr. 2, 1975

[21] Appl. No.: 564,324

[52] U.S. Cl. ..... 272/63; 273/55 R

[51] Int. Cl.[2] ..... A63B 3/00

[58] Field of Search ..... 272/60 R, 57 R, 61, 272/62, 63, 64, 59 C; 273/55 R

[56] References Cited

UNITED STATES PATENTS

| | | | |
|---|---|---|---|
| 3,532,142 | 10/1970 | Ziegler | 145/50 D |
| 3,679,203 | 7/1972 | Grana | 272/60 R |
| 3,782,724 | 1/1974 | Rottman et al. | 273/55 R |
| 3,827,689 | 8/1974 | Hyde | 272/63 |
| 3,831,941 | 8/1974 | Pease | 273/55 R |
| 3,874,375 | 4/1975 | Penner | 272/63 |

FOREIGN PATENTS OR APPLICATIONS

| | | | |
|---|---|---|---|
| 459,842 | 9/1968 | Switzerland | 272/60 R |

OTHER PUBLICATIONS

Martial Arts Supplies Co. Ad from Mar. 1973, Black Belt Magazine, p. 55.

*Primary Examiner*—Richard C. Pinkham
*Assistant Examiner*—Harry G. Strappello
*Attorney, Agent, or Firm*—Clarence A. O'Brien; Harvey B. Jacobsen

[57] ABSTRACT

Uneven parallel bars commonly used by female gymnasts have a resilient pad mounted on the lower of the bars for protecting vulnerable parts of the gymnast's body from injury during extensive contact with the lower bar. The pad has a cylindrically shaped tube constructed from a covered core of a resilient material, and is provided with a slot extending along the entire length of the tube. By shaping the slot to the cross section of the lower bar for mating with the latter, the pad is retainingly received on the lower bar. Further, straps can be provided on the tube for securing the pad to the lower bar.

7 Claims, 4 Drawing Figures

PROTECTIVE CUSHION FOR GYMNASTIC EQUIPMENT

BACKGROUND OF THE INVENTION

1. Field of the Invention

This invention relates generally to a protective cushion for gymnastic equipment, and particularly to a protective cushion especially for the lower bar of uneven parallel bars.

2. Description of the Prior Art

A group of popular and well known physical exercises usually referred to as gymnastics are often performed on specially constructed equipment. Included in this equipment are the parallel bars, which may either have parallel bars or unparallel, or uneven, bars. The latter is commonly used by women and girls only.

A difficulty encountered in the use of the parallel bars, and the like, is that the body of the gymnast is exposed to severe body blows with resulting sores, bruises, and similar injuries, during their training periods. The longer the training period, the greater is the risk of the gymnast sustaining physical punishment.

It is known generally to provide cushioned surfaces on exercising equipment. For example, U.S. Pat. No. 2,919,918, issued Jan. 5, 1960 to C. L. Horn, U.S. Pat. No. 3,077,347, issued Feb. 12, 1963 to J. L. Nova, and U.S. Pat. No. 3,114,545, issued Dec. 17, 1963 to C. L. Horn, disclose cushion supports arranged in parallel relationship on a stand or platform specifically intended for performing headstands, and the like. These headstands, however, are not constructed in a manner inducive to the performance of various difficult gymnastic exercises commonly performed on the, for example, uneven parallel bars.

It is also well known, as shown in, for example, U.S. Pat. No. 3,338,542, issued Aug. 29, 1967 to J. A. Meinhard, and U.S. Pat. No. 3,634,925, issued Jan. 18, 1972 to W. R. Van Loo, to construct padded armrests, and the like, in the form of a resilient core enclosed by a suitable covering material such as leather or a synthetic material which simulates leather. There is, however, a problem with padding the bars of parallel bars, and the like since the padding may affect the ability of the gynmast to firmly grip the bar during difficult exercises, with a resulting increase in the chances of the gymnast to sustain physical injury.

SUMMARY OF THE INVENTION

It is an object of the present invention to provide uneven parallel bars having a resilient pad arranged for reducing the chance of physical punishment to the gymnast and accordingly increasing the periods during which a performer can practice safely.

It is another object of the present invention to provide uneven parallel bars having a cushioned pad that does not adversely affect the performance of a difficult exercise by a gymnast.

It is still another object of the present invention to provide uneven parallel bars having a cushioned pad movably mounted on one of the bars so as to be pushed from place to place on the bar during the performance of a continuous gymnastic routine.

These and other objects are achieved according to the present invention by providing uneven parallel bars including a framework having a base portion, an upper bar mounted on the framework, and a lower bar mounted on the framework and arranged substantially parallel to the upper bar, with the lower bar being disposed closer to the base portion than the upper bar, and having a resilient pad mounted on the lower bar and arranged for protecting vulnerable parts of a gymnast's body from injury during extensive contact with the lower bar. Advantageously, the resilient pad is slidably mounted on the lower bar for being pushed back and forth so that the performer can continue a routine without breaking stride.

According to a preferred embodiment of the present invention, the pad includes a cylindrically shaped tube having a length, constructed from a resilient material, and provided with a slot extending along the entire length of the tube. By shaping the slot, as well as dimensioning same, so that the slot will mate with the lower bar of the uneven parallel bars, the pad will be retainingly received on the lower bar.

The pad can advantageously further include at least one strap affixed to an outer surface of the tube for holding the pad in place on the lower bar during execution of more difficult gymnastic feats, while still permitting the pad to slide along the bar in order to be pushed back and forth at the option of the performer.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
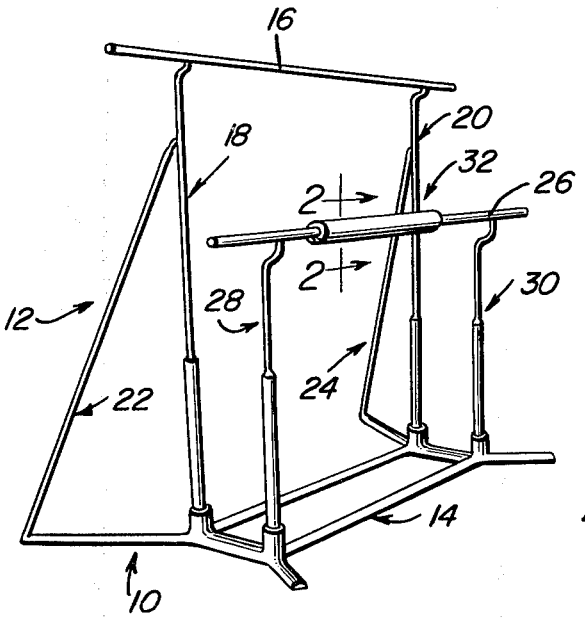
FIG. 1 is a perspective view showing uneven parallel bars according to the present invention.

Referring more particularly to FIG. 1 of the drawings, uneven parallel bars 10 according to the present invention include a framework 12 having a base portion 14, an upper bar mounted on framework 12 as by adjustable uprights 18 and 20 having upper parts slidably engaging the upper ends of rigidifying braces 22 and 24, respectively, and a lower bar 26 mounted on framework 12 as by adjustable uprights 28 and 30. Since the general construction of the uneven parallel bars 10 is conventional and generally well known, it will not be discussed in greater detail herein. As will be appreciated, bars 16 and 26 are generally parallel to one another, with lower bar 26 being disposed closer to base portion 14 of framework 12 than is disposed the upper bar 16. A resilient pad 32 according to the present invention is mounted on lower bar 26 and arranged with respect thereto for protecting vulnerable parts of the body of a gymnast (not shown) from injury during extensive contact with lower bar 26.

Pad 32 advantageously includes a generally cylindrically shaped tube 34 having a predetermined length and constructed from a suitable resilient material. A slot 36 is provided in tube 34 so as to extend along the entire length of the tube 34, with slot 36 being shaped and dimensioned for mating with the lower bar 26 and permitting pad 32 to be retainingly received on lower bar 26. This arrangement is readily apparent from FIG. 2 of the drawings, where it can be seen that lower bar 26 has a generally ovate, or egg-shaped, cross section. Accordingly, once slot 36 is provided in tube 34, the latter may be thought of as having a generally U-shaped or C-shaped cross section.

Tube 34 is preferably constructed from a suitable, known resilient material, such as natural or synthetic foam rubber. The latter forms a core 38 of tube 34, while a suitable cover 40 is arranged over core 38 for protecting and confining the resilient material forming core 38. As will be appreciated, cover 40 may be formed from leather or a suitable simulated leather, such as a material constructed from polyvinyl chloride resin, so as to provide the requisite flexibility and sureness of grip required by pad 32. As perhaps can best be seen from FIG. 3 of the drawings, the material forming cover 40 is formed to the slotted-cylindrical shape of tube 34, while specially cut substantially C-shaped end pieces 41 are fitted over the ends of tube 34. The various pieces of material forming cover 40 may be attached to one another in a conventional manner, such as by stitching or bonding with an adhesive, or both 43.

Figure 2:
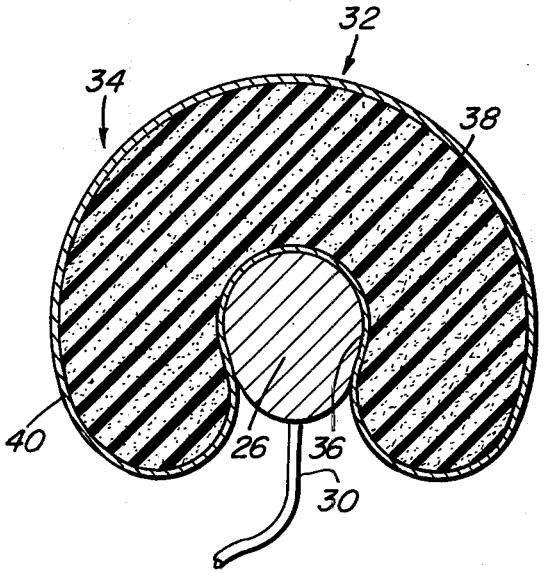
FIG. 2 is a fragmentary, sectional view taken generally along the line 2—2 of FIG. 1, but drawn to a larger scale.
Figure 3:
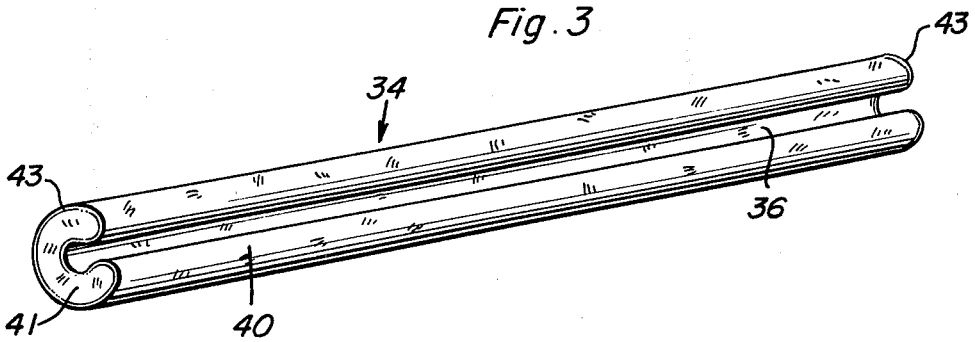
FIG. 3 is a perspective view showing the pad of FIGS. 1 and 2.
Figure 4:
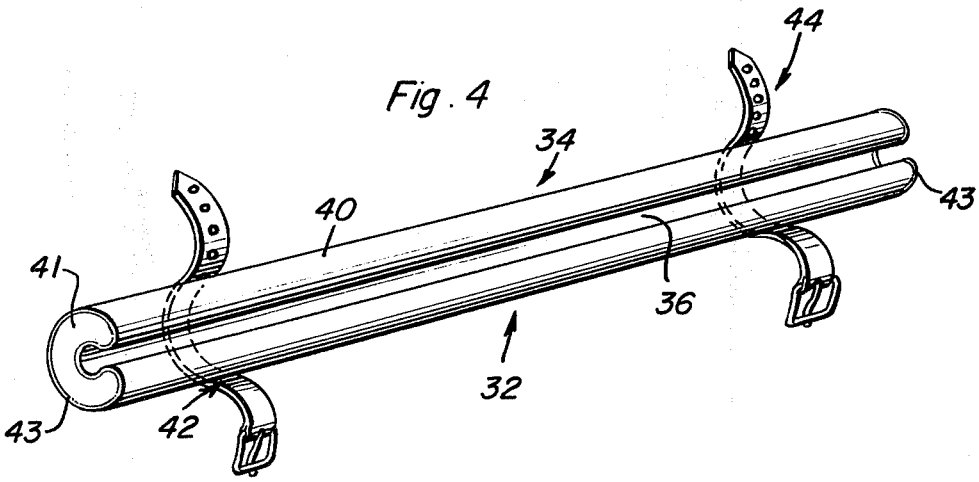
FIG. 4 is a perspective view similar to FIG. 3, but showing a modified form of a pad according to the present invention.

As can be seen in FIGS. 2, 3 and 4, the outermost edges of the slot are closer together than the innermost or central portion thereof, which results in a snap-on type action of the resilient tube when it is placed over the bar and functions to frictionally retain the pad on the ovate-shaped bar.

Referring now to FIG. 4 of the drawings, pad 32 may be provided with one or more straps advantageously affixed to the outer surface, or cover 40, of tube 34 in a conventional manner, as by stitching and/or bonding. FIG. 4 shows a pair of straps 42, 44 so disposed on tube 34. Each of the straps 42, 44 is provided with conventional buckle-type fastening elements for permitting straps 42, 44 to be passed around lower bar 26 and securely strap pad 32 onto lower bar 26 for holding the pad 32 in place on the bar 26 during execution of more difficult gymnastic feats. This permits an instructor (not shown) to concentrate on spotting the gymnast while same bounces off pad 32 to the high, or upper, bar 16 and returns safely to lower bar 26 with little or no assistance. While pad 32 is designed to be snapped, for example, onto bar 26 and held there with or without straps 40, 42, the latter provide additional security and protection to the gymnast while performing more difficult feats.

While it will be appreciated that the dimensions of pad 32 will vary in accordance with the size of lower bar 26, a tube 34 which is, for example, 5¾ inches in diameter by 4 feet long and constructed from polyurethane flexible foam rubber covered with leather, and the like, has been found satisfactory for use with conventionally sized equipment. Further, a tube 34 of this general size would commonly be employed with a lower bar 26 having a maximum horizontal diameter of approximately 1 13/16 inches, which will require the corresponding diameter of slot 36 to be similar throughout the full length of tube 34.

As will be appreciated from the above description and from the drawing, uneven parallel bars 10 provided with a pad 32 on the lower bar 26 thereof result in a piece of gymnastic equipment which provides for cushioning of the impact of severe body blows, reduces bruises and injuries, and allows a gymnast to practice safely for longer periods of time, with less punishment, than with conventional gymnastic equipment of this kind.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with gymnastic equipment known as uneven parallel bars includng a framework having a base portion, an upper bar mounted on the framework, and lower bar of substantially ovate shape in cross-section mounted on the framework and arranged substantially parallel to the upper bar, the lower bar disposed closer to the base portion than is disposed the upper bar; a resilient pad mounted on the lower bar and arranged for protecting vulnerable parts of a female gymnast's body from injury during extensive contact with the lower bar, the pad including a cylindrically shaped tube having a predetermined length, constructed from a resilient material, and provided with a slot extending along the entire length of the tube, the slot shaped and dimensioned for snap-action mating with the ovate-shaped lower bar and permitting the pad to be frictionally retained on the lower bar.

2. A structure as defined in claim 1, wherein the pad further includes at least one strap affixed to an outer surface of the tube for holding the pad in place on the ovate-shaped lower bar during execution of more difficult gymnastic feats.

3. A structure as defined in claim 1, wherein the tube includes a core constructed from resilient foam rubber material and a leather cover arranged over and confining the resilient material.

4. A structure as defined in claim 3, wherein the pad further includes at least one strap affixed to an outer covering of the tube for holding the pad in place on the lower bar during execution of more difficult gymnastic feats.

5. A structure as defined in claim 3, wherein the leather cover has C-shaped end portions at each end of the tube appropriately stitched to the said leather cover.

6. A structure as defined in claim 1, wherein the tube includes a core constructed from resilient foam rubber and a cover of polyvinyl chloride material arranged over and confining the resilient material.

7. A structure as defined in claim 6, wherein the polyvinyl chloride cover has C-shaped end portions at each end of the tube appropriately bonded to the cover with adhesive means.

* * * * *